United States Patent [19]

Hollingsworth

[11] Patent Number: 4,589,555

[45] Date of Patent: May 20, 1986

[54] MAIL SORTING APPARATUS AND METHOD

[76] Inventor: James A. Hollingsworth, 4057 S. Wisteria Way, Denver, Colo. 80237

[21] Appl. No.: 522,535

[22] Filed: Aug. 12, 1983

[51] Int. Cl.[4] ..... B07C 3/20

[52] U.S. Cl. ..... 209/703; 209/900

[58] Field of Search ..... 209/702, 703, 705, 900, 209/923, 936, 942, 584; 198/817, 456; 271/184, 225

[56] References Cited

U.S. PATENT DOCUMENTS

| | | | |
|---|---|---|---|
| 1,581,583 | 4/1926 | Low | 271/184 |
| 1,990,227 | 2/1935 | Fairchild | 209/705 X |
| 2,991,687 | 7/1961 | Henebry | 209/705 X |
| 3,411,622 | 11/1968 | Dickie | 209/942 X |
| 4,140,627 | 2/1979 | Weller et al. | 209/3.3 |
| 4,201,377 | 5/1980 | Honegger | 271/225 |
| 4,203,694 | 5/1980 | James | 198/456 X |
| 4,314,644 | 2/1982 | Stocker | 209/900 X |

FOREIGN PATENT DOCUMENTS

| | | | |
|---|---|---|---|
| 0121814 | 8/1946 | Australia | 209/703 |
| 0099308 | 7/1940 | Sweden | 198/346 |

*Primary Examiner*—Randolph A. Reese
*Assistant Examiner*—Edward M. Wacyra
*Attorney, Agent, or Firm*—Jerry W. Berkstresser; Bruce G. Klaas

[57] ABSTRACT

A mail sorting system employing a modified mail conveyor in combination with a sorting table where articles of mail moving linearly in the direction of their longest dimension are deposited in a shingled pattern onto an angled sorting table surface provided with a conveyor so that the articles of mail are conveyed in the direction of their shortest dimension and in partial overlapping relationship.

4 Claims, 2 Drawing Figures

MAIL SORTING APPARATUS AND METHOD

This invention relates generally to a method and apparatus for the mechanized handling of articles of mail and more particularly to an apparatus and method for efficient high speed mail sorting.

For several years, the U.S. Postal Service has offered discounts on regular postage rates to those large mailers who sort and prepare mail to certain specifications.

Discounts have been increased in recent years, making it economically attractive for mailers to develop methods and procedures to meet the required specifications. These discounts are now available on First Class, Second Class and Third Class mail.

There are presently three levels of progressively finer sorting and preparation specified for each of the three classes of mail. Each of the two higher levels is allowed a discount from regular postage rates; the finer the sort, the greater the discount. Discounts, at the present time, go to a maximum of 4.0¢ per piece for First Class mail, 2.6¢ per piece for Second Class mail, and 3.6¢ per piece for Third Class mail. Discounts are justified by U.S. Postal Service on the amount of labor eliminated within the postal system.

Simply stated, sortation and preparation specifications require that for a given batch of mail to qualify for a postage discount, all pieces addressed to a particular post office defined by either the first three digits or all 5-digits of the Zip Code must be bundled together, tied, and placed in containers routed to that post office. If these bundles are further sorted to the particular route numbers of the individuals carriers working out of each post office, the highest postage discount is allowed.

A common practice for large mailers to accomplish the required sorting and preparation, at the lowest cost, is to utilize data processing methods to address their mail in numerical zip code sequence.

Typically, addresses are affixed directly to mailing envelopes or to an enclosure which will show through the window of the mailing envelope.

Sorting is the process of identifying what are called the breaks or changes in the zip code sequence that indicate a change in the destination post office, and then separating and removing those like pieces from the stream for bundling.

This invention applies to that portion of mail which is enclosed in any of several standard size mailing envelopes, as distinguished from self-mailers which includes magazines, brochures, and the like.

There have been commercially produced mail inserting machines available for many years, which will stuff from one to six, or more, enclosures into a mailing envelope. Pitney-Bowes is a leading manufacturer and supplier of this type of machine.

The design of the Pitney-Bowes mail inserting machine however, does not provide for an efficient way to perform the sorting task. The machine stacks envelopes directly on top of each other, at a maximum rate of about two pieces per second, precluding any possibility of visually determining the zip code breaks in a typical stream of mail. Typically, a break will occur 5–10 times per minute in a typical stream of mail.

A common sorting procedure used in mail rooms is to unload the stacked letters from a bin on the inserting machine, and place them in trays holding about 500 pieces. Each piece must then be examined manually to visually locate zip code breaks. This is a relatively slow, labor intensive and, therefore, a high cost procedure. It is also an inherently imprecise procedure when attempted at high rates of output.

Up until July, 1982, a high degree of imprecise sorting was tolerated by the U.S. Postal Service. Earlier studies by the General Accounting Office determined that the added handling cost incurred by U.S. Postal Service, due to improper preparation of this type mail, was extremely high. As a result of this study, U.S. Postal Service implemented the General Accounting Office recommendations for system wide sampling and verification of every batch of incoming bulk mail, and other mail presented for postage discount, to determine if preparation was done properly. This policy was implemented in July, 1982. A sample error of 10% or more will now cause the entire batch to be returned to the mailer for reworking to correct any deficiency revealed by the sample.

A result of this new, more stringent control over the quality of mail preparation has been higher costs in mail rooms, as businesses strive to assure proper sorting and preparation.

It is therefore an objective of the present invention to provide an apparatus for achieving improved mail handling and sorting.

It is also an objective of the present invention to achieve more accurate mail sorting while reducing the cost of the mail sorting operation.

It is a further objective of the present invention to provide a method of mail handling that achieves the foregoing objectives.

BRIEF SUMMARY OF THE INVENTION

Conventional envelope stuffing equipment generally is provided with a conveyor table that ejects filled mail envelopes serially in the direction of the longest dimension of the envelope.

The present invention provides a sorting table adjacent to the end of a generally horizontal conveyor table that is structurally adapted to serially receive the envelopes conveyed by the conveying table in a partially overlapped relationship by adjustment of the speed of the conveying means on the sorting table to match an increased speed provided to the modified conveyor table. This speed can be controlled by the inserter operator, but slow speed would probably not work well with the sorter.

The variable speed mail sorting table disclosed is capable of being used with a modified conveyor table associated with commercial mail handling equipment by the use of a structure which includes sorting table surface means for receiving and collecting pieces of mail for subsequent sorting; support means for supporting the sorting table surface means at a height generally below the height of the modified conveyor used, the surface being generally rectangular and generally angled from the horizontal in a direction away from the conveyor table and generally perpendicular and adjacent to the conveyor table and extending past the exit end of the conveyor table a sufficient distance to receive articles conveyed by the conveying table, the surface means being wide enough to receive articles delivered from the exit end of the conveying table; guide means located on the lower side of the surface means on the sorting table and capable of preventing articles received onto the surface means from sliding off the sorting table after being delivered thereto; and conveying means included on the surface means for conveying articles received on the surface means from a position near the exit end of the conveying table to a position remote therefrom whereby articles received from the conveying table are retained on the surface means by the catcher means and are conveyed serially by the conveying means generally perpendicularly from the conveyor table in a direction away from the position where they are received on the surface means.

DETAILED DESCRIPTION OF THE DRAWINGS

Figure 2:
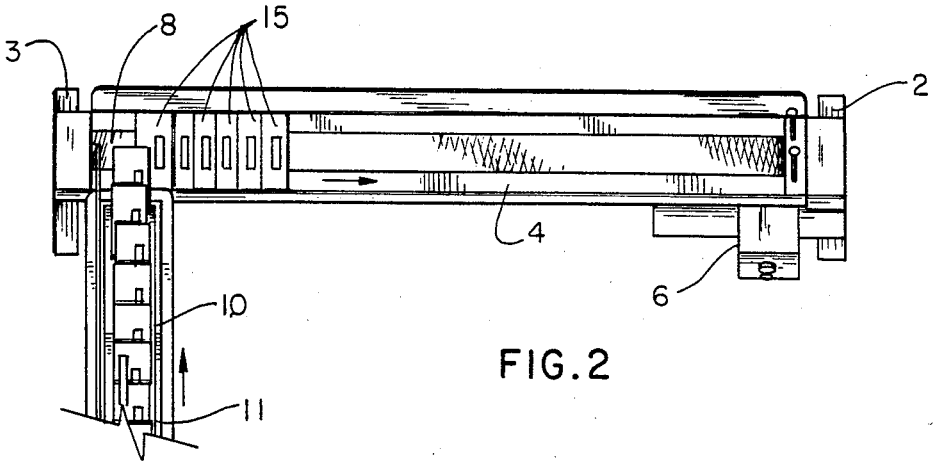
FIG. 2 is a plan view of the device of the present invention.
Figure 1:
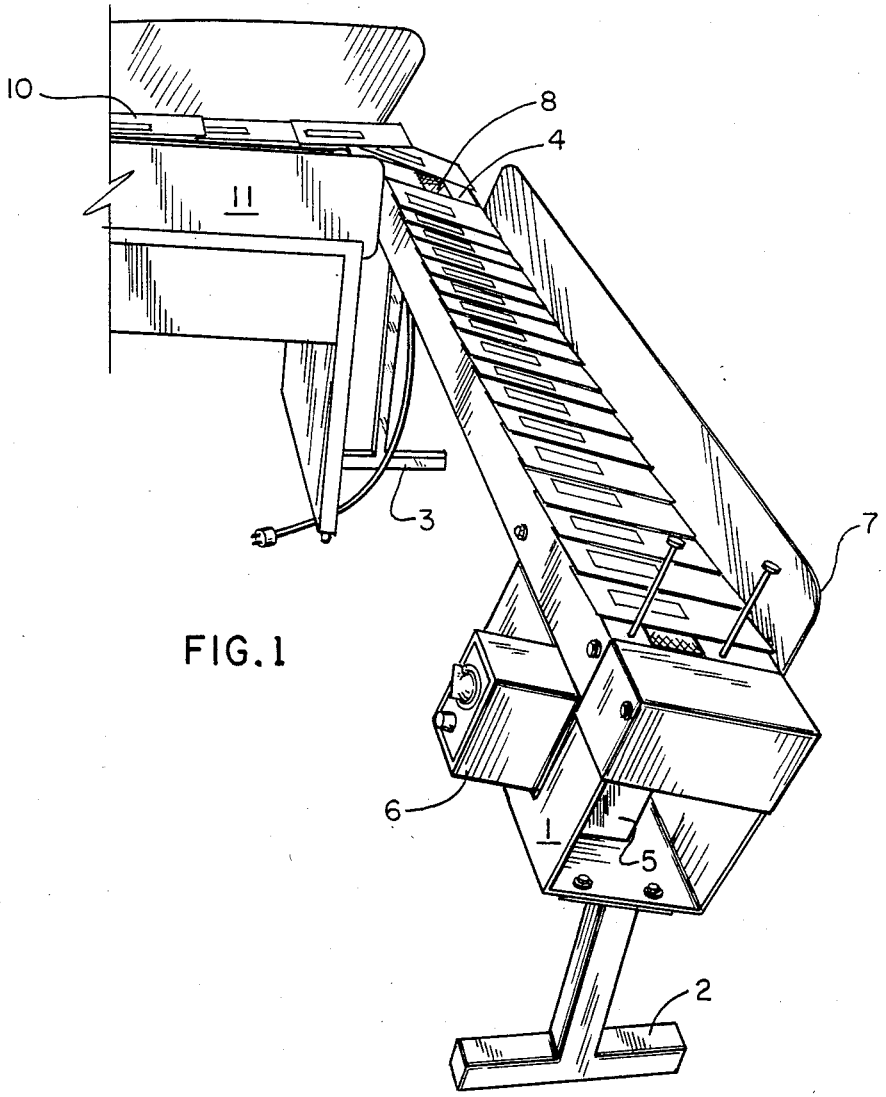
FIG. 1 is an isometric view of the conveyor sorter device of the present invention.

The sorting table 1, of the embodiment of the present invention shown, contains support members 2 and 3 which support an angled table surface 4, the belt drive 5, variable speed controller 6, guide means or catcher 7 and belt 8. These elements, when arranged as shown, and properly sized are capable of receiving articles of mail 10 from a modified exit conveyor 11 of a mail inserter machine. If the speed of delivery from the exit conveyor 11 is altered by changing the conventional drive pulley (not shown) to a larger diameter, it is possible to increase the mail feed rate from conveyor 11 onto sorter 1 from about 3.55 inches per second to 7.75 inches per second. At this rate the interleaved mail articles 10 on conveyor 11 (shown in FIG. 2) can be conveyed onto sorter 1 in the manner shown in FIG. 2 when the speed of the belt 8 is adjusted properly by speed control 6. A standard belt drive unit 5 such as obtainable from Dayton Electric Manufacturing Co., Chicago, Ill. 60648 is controlled by a solid state controller 6 (also obtainable from Dayton Electric Manufacturing Co., Chicago, Ill. 60648) to provide for the proper rate of movement of the shingled mail articles 15 on the sorter surface 4, as shown in both Figures. A conventional belt and pulley arrangement, which is not shown in detail, is employed by mounting the pulleys underneath the sorter table surface 4 so that the belt 8 lies flat on the surface 4 and can be moved at varying speeds in the direction shown by the arrow in FIG. 2. The return path for the belt 8 is partially enclosed by the skirt structure of the sorter 4 and is underneath the sorter table surface so as not to be exposed to the user. The catcher 7 is preferably a rigid sheet material extending generally perpendicularly upward from the sorter table surface 4 a sufficient height to permit efficient capture of the mail articles 10 which are fed onto the surface 4 by the inserter conveyor 11. The catcher 7 is also sized to extend a sufficient length along the sorter table surface 4 so as to prevent the mail articles from sliding off of the inclined surface 4 before having been sorted and removed by a user (not shown). Most preferably, the sorter table surface can be made adjustable in vertical height by, for example, adjustment means on the bottom of the sorter table supports. Other adjustment features can also be provided for the angle of the sorter table surface and the position of the backguide or catcher.

A key design factor to achieving a simple interface between the sorter and inserter, is the change to increase the fixed speed of the inserter conveyor belt by a factor of about $2\frac{1}{4}$. At this speed all popular sizes of business envelopes are given enough momentum to be projected from the inserter belt and to drop precisely on the moving belt of the sorter in a shingled pattern, where the addresses are completely exposed. Slower speeds will not generate adequate momentum. Faster speeds allow too much interval between envelopes on the inserter conveyor belt. Either case results in the leading edge of the envelope dropping on the moving sorter belt, instead of being completely received on the inclined table, thereby preventing formation during operation of the necessary shingled pattern.

In addition to the critical speed and momentum of the mail articles on the inserter conveyor, there are two critical points of sorter geometry; the vertical distance from the inserter conveyor belt to the sorter conveyor belt; and the angle at which the top surface of the sorter is inclined.

If vertical distance between the two belts is too small, the letter will not drop freely; if the distance is too large, the leading edge of the letter will fall on the moving sorter belt. Both conditions prevent forming the necessary shingled pattern.

If the angle of sorter incline is too flat, the letter will not move to the backguide or catcher; if the angle is too steep, the leading edge of the letter will fall on the moving sorter belt. Both conditions prevent forming the necessary shingled pattern.

This invention, while offering a reduction in sorting labor of 50%–75%, also provides a technique that results in fewer sortation errors. How the cost and quality benefit are achieved becomes apparent in a comparison of sorting procedures. The sorter operator utilizing the present invention will be seated in a comfortable position at the sorting table. As the "shingled" letters are conveyed along the length of the machine, the operator may scan up to 50 addresses, to find the breaks in the zip code sequence. At the maximum operating speed of the Pitney-Bowes inserter (7,000 pieces per hour), mail on the sorter would move by the operator at a speed of two inches per second; a comfortable rate for making up to 10 breaks per minute. The operator conveniently and accurately gathers those pieces of mail between each break, and passes that bundle to someone for tying and placing in the proper container. Production is thereby machine paced, but manageable. The amount of physical activity, exertion and handling associated with this new mechanized method is less than half that used by the present method of sorting from trayed material exhausted from an unmodified conveyor table. The present, less efficient manual method currently employed requires a person to remove a comfortable handful (25–40 pieces) of letters from the tray, and fan them rapidly with their thumb, while looking for the zip code break; then to replenish the handful and repeat the process. Attempting to balance speed and accuracy is always a compromise. The procedure is tedious, and speed is dependent upon the ability and motivation of individuals such that in normal practice the inserter is normally operated at much slower speeds. The apparatus and method of the present invention therefore provides a superior system for complying with the U.S. Postal Service requirement for discount mail rates which are provided for improvements in their efficiency.

While this invention has been described with respect to one embodiment thereof, it should be appreciated that variations in the specific components described are possible while still obtaining the advantage disclosed herein.

It is contemplated that the inventive concepts described may be variously otherwise embodied and it is intended that the appended claims be construed to include alternative embodiments of the invention except insofar as limited in scope by the prior art.

What is claimed is:

1. A variable speed mail sorting apparatus for manual mail sorting when used with the exit end of a conveyor table associated with commercial mail inserting equipment comprising:

sorting table surface means for receiving and collecting pieces of mail for subsequent manual sorting;

support means for supporting the sorting table surface means at a height generally below the height of the mail handling conveyor table used, said surface means being generally rectangular and generally angled from the horizontal, downwardly in a direction away from the exit end of the mail inseting conveyor table at a preselected angle for receiving said pieces of mail in a shingled overlapping relationship, said surface means being generally perpendicular and adjacent to said conveyor table and extending past the exit end of the conveyor table a sufficient distance to receive articles conveyed by said conveyor table, said surface means being wide enough to completely receive articles delivered from the exit end of the conveyor table;

guide means located on the lower side of the surface means on said sorting table extending upwardly therefrom and capable of preventing articles received onto the surface means for sliding off the sorting table after being delivered thereto; and first conveying means included on said sorting table surface means for conveying articles received on said surface means from a position near the exit end of the conveyor table to a position remote therefrom whereby the mail articles are received in a preselected timed relationship from the conveyor table and are moved on said surface means by said first conveying means at a preselected speed so as to be retained in a predetermined overlapping relationship on said sorting table surface means by said guide means and are conveyed in said predetermined overlapping relationship by said first conveying means generally perpendicularly, from the conveyor table in a direction away from the position where they are received on the surface means, so as to be capable of manual sorting by zip code breaks.

2. The variable speed mail sorting table of claim 1 wherein the first conveying means is capable of conveying articles of mail received thereon at speeds up to about 8 inches per second in a shingled pattern so as to expose the address to the view of the sorter operator for ease of sorting for zip code breaks.

3. A mail handling system for use with conventional envelope stuffing equipment comprising:

sorting table surface means located adjacent to the exit end of said envelope stuffing equipment, said surface means located generally below, perpendicular, and angled downwardly, away from an exit end of said envelope stuffing equipment for receiving said articles of mail for subsequent manual sorting;

support means for supporting the sorting table surface means at a height generally below the height of said equipment used, said surface means being generally rectangular and generally angled from the horizontal between about 12° to about 18° and in a direction away from the exit end of said equipment used and capable of supporting the articles conveyed by said equipment, said surface means being wide enough to receive articles delivered from the exit end thereof;

guide means located on the lower side of the surface means on said sorting table surface means and upstanding therefrom and capable of preventing articles received onto the surface means for sliding off the sorting table surface means after being delivered thereto; and conveying means included on said sorting table surface means capable of conveying rectangular mail articles received on said surface means in the direction of their shortest dimension at preselected speeds from a position near the exit end of said equipment to a position remote therefrom whereby articles received on said surface means are retained on said surface means by said guide means and are conveyed by said conveying means on said surface means so as to provide a predetermined overlapping relationship of said articles on said conveying means moving in a direction away from the position where they are received on the surface means, whereby manual sorting of the mail articles is facilitated.

4. The mail handling system of claim 3 wherein the speed of the conventional mail stuffing equipment is preselected so as to provide, in combination with the speed of said conveying means on said surface means so that delivery of mail articles to said sorting table surface means provides a moving shingled pattern of moving mail articles on said sorting table surface means with the address exposed to the view of the sorter operator whereby sorting visually for zip code breaks is facilitated.

* * * * *